US006733251B2

(12) United States Patent
Sakurabayashi et al.

(10) Patent No.: US 6,733,251 B2
(45) Date of Patent: May 11, 2004

(54) COMPRESSOR WITH BUILT-IN MOTOR AND MOBILE STRUCTURE USING THE SAME

(75) Inventors: Tsutomu Sakurabayashi, Kadoma (JP); Masahiko Makino, Shiga (JP); Yoshifumi Abe, Ritto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 4 days.

(21) Appl. No.: 10/164,638

(22) Filed: Jun. 10, 2002

(65) Prior Publication Data

US 2003/0002999 A1 Jan. 2, 2003

(30) Foreign Application Priority Data

Jun. 8, 2001 (JP) ..... 2001-174432

(51) Int. Cl.[7] ..... F04B 17/00; F25B 27/00

(52) U.S. Cl. ..... 417/360; 417/410.5; 417/423.15; 62/236; 418/55.1; 184/6.16

(58) Field of Search ..... 417/374, 410.1, 417/411, 410.5, 423.7, 423.14, 423.13, 321, 360, 423.12, 423.15; 62/236; 418/55.1; 184/6.16

(56) References Cited

U.S. PATENT DOCUMENTS 3,335,942 A * 8/1967 Siegart ..... 417/384
3,417,704 A * 12/1968 Pall et al. ..... 417/423.12
3,565,553 A * 2/1971 Rinehart et al. ..... 417/423.12
4,105,372 A * 8/1978 Mishina et al. ..... 417/243
5,211,031 A * 5/1993 Murayama et al. ..... 62/498
5,226,294 A * 7/1993 Mayer ..... 62/323.1
6,264,446 B1 * 7/2001 Rajendran et al. ..... 418/55.6
6,361,293 B1 * 3/2002 Harper et al. ..... 417/363
6,540,489 B1 * 4/2003 Higashiyama ..... 417/410.1
6,544,009 B2 * 4/2003 Makino et al. ..... 417/312
6,619,933 B2 * 9/2003 Ikeda ..... 417/410.1

* cited by examiner

*Primary Examiner*—Justine R. Yu
*Assistant Examiner*—Michael K. Gray
(74) *Attorney, Agent, or Firm*—Greenblum & Bernstein, P.L.C.

(57) ABSTRACT

A compressor with a built-in electric motor has a compression mechanism and the built-in electric motor which are housed in a container. A suction port, a discharge port, inner and outer electric connection parts, and mounting legs of the container are provided on the same side of a body of the container. A bearing part for supporting an end of a driving shaft for driving the compression mechanism is formed on an end wall integral to -the body of the container, where the end of the driving shaft to be supported by the bearing part is located in the direction opposite to the compression mechanism and the driving shaft is connected to the built-in electric motor. In addition, a pumping mechanism is provided in a pumping chamber opened to an external surface of the end wall and is connected to the end of the driving shaft in the direction opposite to the compression mechanism. The opening of the pumping chamber is closed by a closing member. Thereby, the reduction in size and weight of the compressor with the built-in electric motor is achieved.

22 Claims, 9 Drawing Sheets

COMPRESSOR WITH BUILT-IN MOTOR AND MOBILE STRUCTURE USING THE SAME

The present disclosure relates to subject matter contained in priority Japanese Patent Application No. 2001-174432, filed on Jun. 8, 2001, the contents of which is herein expressly incorporated by reference in its entirety.

BACKGROUND OF THE INVENTION

1. Field of the Invention

The present invention relates to a compressor with a build-in electric motor which is suitable to be mounted on a mobile structure such as a motor vehicle. The invention also relates to a mobile structure having such a compressor.

2. Description of Related Art

In a vehicle driven only by an engine, a compressor driven by the engine has been used for air-conditioning the vehicle compartment with the compressor being mounted alongside of the engine.

Hybrid vehicles having both an engine and an electric motor and traveling by use of one of them according to conditions have been practically used for going on public roads. Air-conditioning of the vehicle compartment of this hybrid vehicle is made by a compressor driven by the engine in the same manner as conventional engine-driven vehicles, which compressor is mounted alongside of the engine.

It is proposed that the engines of hybrid vehicles should be shut off while they are temporarily stationary at a place such as a traffic light in order to reduce effects of the engine upon the environment. When the proposal is followed with a vehicle where a compressor driven by the engine is used, air-conditioning stops each time when the vehicle stops, causing problem for the driver and passengers in the compartment in summer and winter seasons, and especially in regions with extremely cold or hot climate.

For solving such a problem, there is an idea of adopting a compressor to be driven by an electric motor, especially a compressor to be used for air-conditioning in a building as shown in FIG. 7. The compressor with a built-in electric motor is housed in a container 102 made of iron, together with a compression mechanism 100 and an electric motor 101. In the hybrid vehicle, furthermore, the arrangement of devices in an engine room is based on that of the conventional motor vehicle. Thus, there is no space or location for installing the conventional compressor with the built-in electric motor for air-conditioning in the building in the engine room, so that the compressor should be mounted alongside the engine.

Regarding such a problem, the present inventors have conducted various experiments and found the following facts. That is, there is an inconvenience that a mounting leg or mounting seat 103 made of a sheet-metal welded on the container 102 requires a seat on the engine side. In addition, the compressor is heavy as much as about 9 kg or more. As the compressor is mounted alongside the engine, the strength of the mounting seat 103 is insufficient with respect to the weight of the compressor and vibrations thereof. In addition, the compressor is forced to receive vibrations of the engine, so that a weld zone between the conventional mounting seat 103 and the container 102 may be fractured, resulting in poor durability and lack of reliability. There is also an idea to prevent the influence of vibrations of the engine to the compressor and to the vehicle compartment by sandwiching an elastic member between the mounting seat 103 and the engine. However, the mounting position of the mounting seat 103 to the engine is greatly varied, so that the position on which the elastic member is to be mounted can be also varied. It results in the increase in the number of components and also the increase in the number of fabrication steps, causing the increase in costs. Furthermore, the elastic member arranged on each of the mounting parts exerts its ability of impact absorption on a restricted area on the mounted part, resulting in poor vibration control. If the vibration control is compensated using any member having a small spring constant, the elastic member tends to be broken between the vibrating engine and the compressor.

Furthermore, the conventional compressor with the built-in electric motor has large axial dimensions. For example, the container 102 extends to approximately 250 mm. That is, a discharge port 104, a suction port 105, inner and outer electric connection parts 106, and the mounting legs 103 are longitudinally extended from both ends of the container 102. In addition, the driving shaft 107 is supported by main- and sub-bearing members 108, 109 independently installed in the container 102 together with the both ends of the driving shaft 107 connected to the electric motor 101. In addition, the driving shaft 107 actuates a pump 110 for oil supply being provided independently from the container 102 on the side of the sub-shaft bearing member 109. Such a complicated construction of the compressor is hardly incorporated in an electric-powered vehicle which has been only realized in a small-sized vehicle.

Simultaneously, the conventional compressor with the built-in electric motor is made of iron, so that the total weight thereof is about 9 kg or more. Thus, it becomes a problem in realizing the high speed and the energy saving because of the increase in driving load when it is mounted on the mobile structure.

On the other hand, as shown in FIG. 8, there is provided a compressor with a built-in electric motor in which a container 120 is made of an aluminum material to reduce the weight of the container 120. In this case, however, the principle configuration of the container 120 is substantially the same as that of the container 102 made of iron except that the axial length of the container 120 is approximately 220 mm which is slightly smaller than that of the container 102. In addition, just as in the case with one shown in FIG. 7, the container 120 is constructed of three container members 120*a*–120*c* by which two independent connection portions 121 are formed on the body. Those shown in FIG. 7 are made of iron and are mutually connected to each other by welding under favor of being designed as maintenance-free without overhaul. However, the container members made of aluminum as shown in FIG. 8 are not suitable for welding, so that they are connected to each other by means of bolt connection. The wall of the aluminum container 120 in the thickness directions is greater than that of the iron container 102 to satisfy the conditions of a pressure container. For the connection with bolts 122, a pair of flange portions 123 in each of the two connection portions 121 is required. Here, the flange portion 123 is protruded outwardly from the periphery of the container 120 in the radial direction. In addition, the flange portion 123 continuously or discontinuously extends around the container 120 in the circumferential direction. In each connection portion 121, a lot of bolts 122, for example eight bolts 122, may be used so that the total weight of the container 120 is approximately 8 to 9 kg. It means that the substantial reduction in the weight of the container 120 is not achieved.

It becomes urgent business to provide a small-sized and lightweight compressor with a built-in electric motor now in a tendency of planning an electric operation of various kinds of load by using a working voltage of 42 volts in a gasoline-powered vehicle, a hybrid vehicle, or an electric-powered vehicle.

SUMMARY OF THE INVENTION

An object of the present invention is to provide a small-sized and light-weighted compressor with a built-in electric motor.

To achieve the above object, a first aspect of the invention is to provide a compressor with a built-in electric motor, where a compression mechanism and a built-in electric motor for driving the mechanism are housed in a container. In the container, a suction port, a discharge port, inner and outer electric connection parts, and mounting legs are provided on the same side of a body of the container.

According to the above configuration, the entire size of the compressor in the axial direction is reduced till it becomes almost equal to the size of the container in the axial direction. In addition, such a concentrated arrangement of structural components on the predetermined area of the container prevents them from taking up much space, compared with the arrangement of structural components dispersed around the container. As the suction port, the discharge port, the electric connection parts, and the mounting legs are arranged in a restricted area so as to be close to each other to share a part of or the whole of the wall of the container in the thickness direction. Thus, the section of the container on which each of them dominantly arranged is reduced. In addition, since the suction port and the discharge port are positioned on the body of the container, a margin for connection of an external pipe is obtained on the internal diameter side by utilizing the fact that each of the outer and inner peripheries of the end of the container tends to become a dead space. The wall of the container in the thickness direction is shared much more, compared with the case of outwardly extending from the container, so that the reduction in size and weight of the container is achieved. The bulk of the container is further reduced as much as the extent of both the suction port and the discharge port which do not protrude out of the container. Consequently, the compressor with the built-in electric motor is made compact and light weight in addition to allow the reduction in cost. Thus, the compressor is easily mounted on the mobile structure such as an automobile and contributes to energy saving.

A second aspect of the invention is to provide a compressor with a built-in electric motor, where a compression mechanism and a built-in electric motor for driving the mechanism are housed in a container, including: a bearing part for supporting an end of a driving shaft for driving the compression mechanism, the bearing part which is formed on an end wall integral to a body of the container, where the end of the driving shaft to be supported by the bearing part is located in the direction opposite to the compression mechanism and the driving shaft is connected to the built-in electric motor; a pumping mechanism provided in a pumping chamber opened to an external surface of the end wall, which is connected to the end of the driving shaft in the direction opposite to the compression mechanism; and a closing member that closes the opening of the pumping chamber.

In such a configuration, the bearing part of the driving shaft on the side of the pump mechanism and the pump mechanism portion are assembled and concentrated in the end wall of the container. Such a concentrated arrangement prevents them from taking up much space, compared with the arrangement of structural components dispersed around the container. In other words, they are arranged in a restricted area so as to be close to each other to share a part of or the whole of the wall of the container in the thickness direction. In addition, they share a part of or the whole of a space in the container in the axial direction, so that the specific section and the specific space in the container are reduced. Thus, the size of the container is reduced in the axial direction. Furthermore, reduction in weight of the whole is achieved as much as reducing the specific section of the container and the axial size of the container. Consequently, the compressor with the built-in electric motor is made compact and light weight in addition to the reduction in cost. The compressor is thus easily mounted on the mobile structure such as an automobile and contributes to energy saving. Furthermore, since a positioning of the bearing and the container becomes unnecessary by integrating the bearing part of the driving shaft into the end wall of the container, the positioning accuracy is increased while an assembling operation becomes ease, thereby reducing the cost.

While novel features of the invention are set forth in the preceding, the invention, both as to organization and content, can be further understood and appreciated, along with other objects and features thereof, from the following detailed description and examples when taken in conjunction with the attached drawings.

DETAILED DESCRIPTION OF PREFERRED EMBODIMENTS

Hereinafter, a compressor with a built-in electric motor as one of preferred embodiments of the present invention and a mobile structure having such a compressor will be described with reference to the accompanying drawings for facilitating the understanding of the invention.

In this embodiment, the compressor is a scroll type compressor with a built-in electric motor to be mounted on an engine of a hybrid vehicle in a horizontal position. However, the invention is not limited to such a type of compressor. The present invention is also applicable to any compressor for air-conditioning of the interior of a room in addition to the vehicle compartment of a typical mobile structure such as a motor vehicle, exerting the advantages of weight reduction and miniaturization. According to the invention, various kinds of compression mechanisms, for example rotary and reciprocation type compression mechanisms, may be used. Furthermore, any vertical type compressor may be used.

Figure 1:
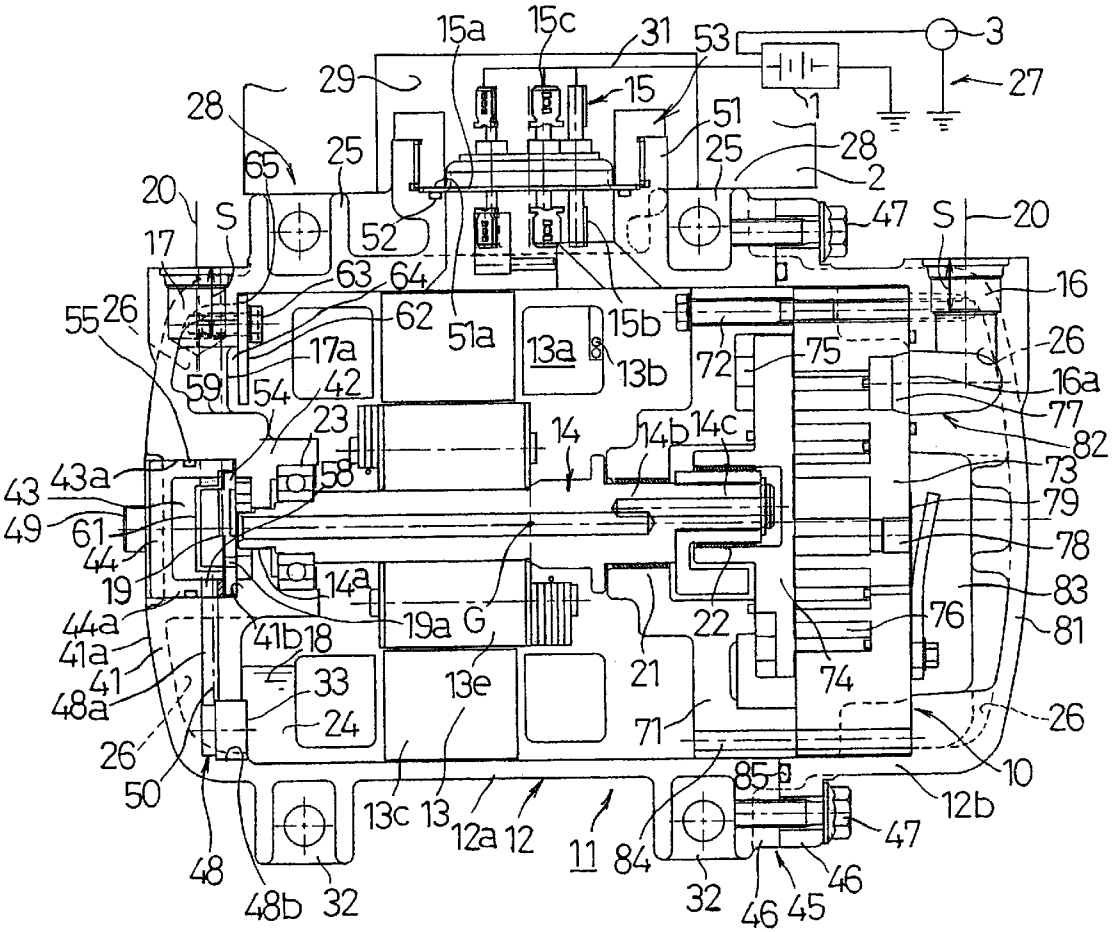
FIG. 1 is a cross sectional view of a compressor with a built-in electric motor in a state of being mounted on an engine according to one embodiment of the present invention.
Figure 2:
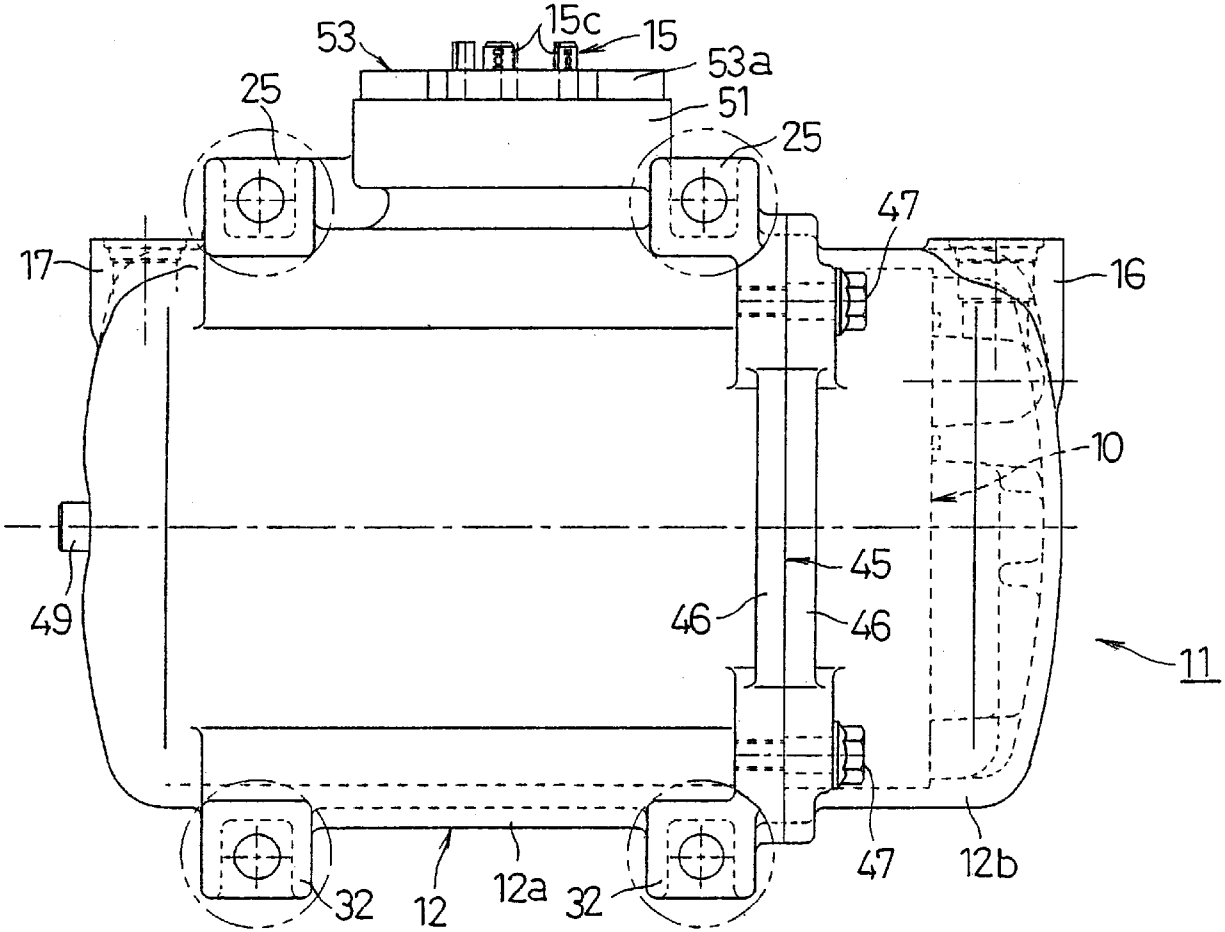
FIG. 2 is a front view of the compressor shown in FIG. 1.
Figure 3:
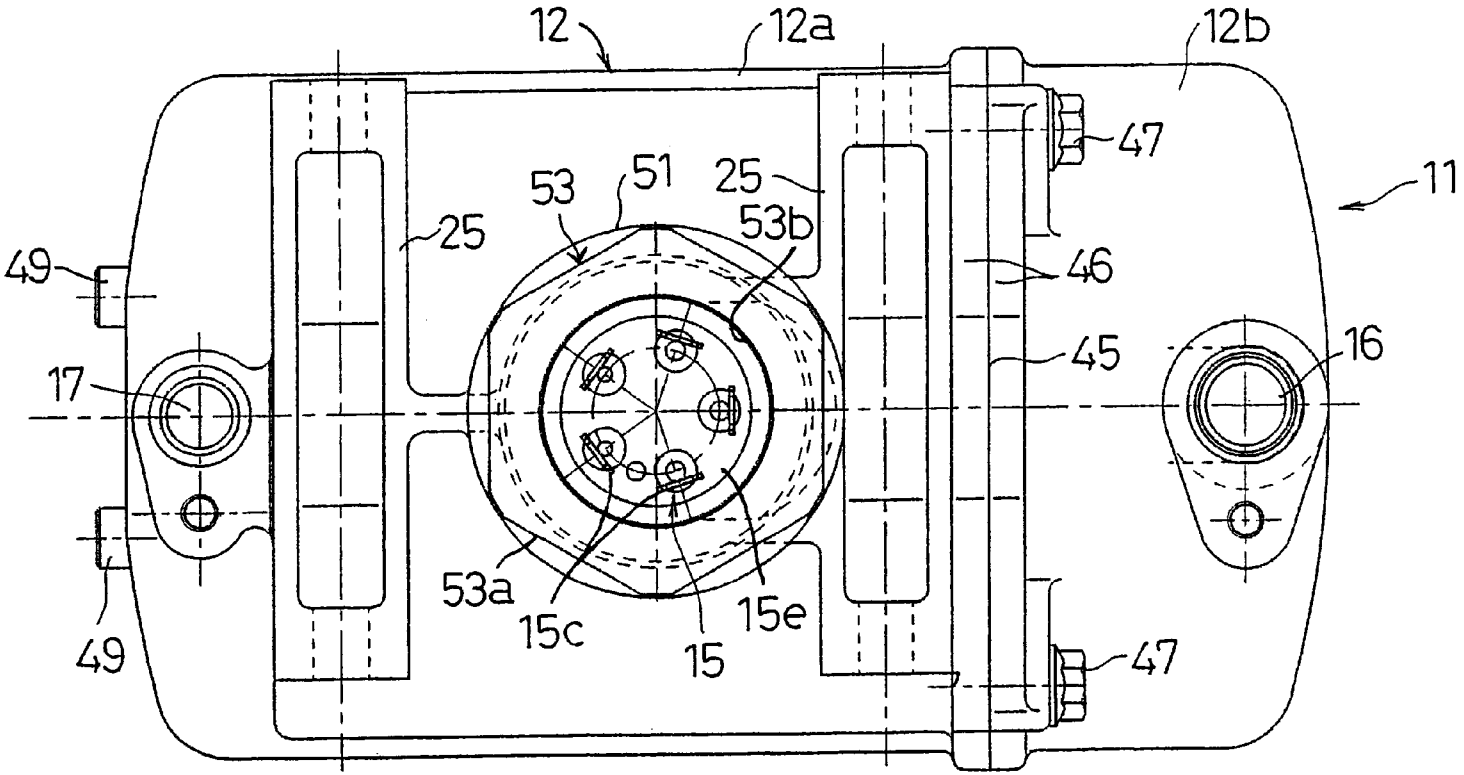
FIG. 3 is a plan view of the compressor shown in FIG. 1.

As shown in FIG. 1, a hybrid vehicle 27 includes a gasoline-powered engine 2 and a motor 3 to be driven by the supply of power from a battery 1. The battery 1 is a rechargeable battery. While the vehicle runs using the engine 2, the battery 1 is charged. While the battery 1 has a sufficient charged capacity, the motor 3 is controlled to receive the supply of power for driving the vehicle with the motor 3 to restrict the discharge of exhaust gas to a minimum. When the vehicle is running with the engine 2, the engine 2 is controlled such that the engine 2 is stopped while the vehicle is temporally stopped, for example at a traffic light.

In this embodiment, as shown in FIG. 1, a compressor 11 driven by a built-in electric motor 13 is used for an air-conditioning of the vehicle compartment of the hybrid vehicle. The compressor 11 is constructed to keep the air-conditioning of the vehicle compartment even though the vehicle running with the engine 2 is temporally stopped at a traffic light or the like and the engine 2 is stopped.

As shown in FIG. 1, a scroll type compression mechanism 10 and the electric motor 13 having a driving shaft 14 to drive the compression mechanism 10 are housed in a container 12 to constitute the compressor 11. The electric motor 13 is operated by the supply of power through a terminal 15 provided as inner and outer electric connection parts of the container 12 to actuate the compression mechanism 10. The compression mechanism 10 inspires a refrigerant after passing through a refrigeration cycle via a suction port 16 of the container 12 to compress the refrigerant. Then, the compressed refrigerant is discharged into the inside of the container 12 to cool the electric motor 13, followed by discharging the refrigerant into an external pipe 20 outside the container 12 via a discharge port 17 of the container 12 to supply the refrigerant to the refrigeration cycle for air-conditioning. Subsequently, these steps are repeated.

In the container 12, there is oil 18 being stored. The oil is inhaled by a pump 19 driven by the driving shaft 14. The oil is then supplied to a main bearing 21 of a main axial part 14*b* of the driving shaft 14 on the side of the compression mechanism 10, a bearing 22 of a coupling portion between the main axial part 14*b* and the compression mechanism 10, and a sliding portion of the compression mechanism 10 to make smooth. After lubricating the bearings and the sliding portion, the oil 18 seeps through each lubricating object by means of a supply pressure and then returns to the inside of the container 12, followed by repeating such a lubricating process. By means of the action of a compatibility, a part of the refrigerant to be discharged into the container 12 brings the oil 18 stored in an oil storage portion 24 in the container 12 into a part such as a sub-bearing 23 which cannot be supplied with oil 18 by the pump 19, lubricating the sub-bearing 23 or the like. The sub-bearing 23 is responsible for bearing a sub-axial part 14*a* on the side of the driving shaft 14 opposite to the compression mechanism 10. Consequently, the compressor 11 having the built-in electric motor of the present embodiment satisfies the requirements for maintenance free.

In the compressor of the present embodiment, as shown in FIG. 1, a suction port 16, a discharge port 17, the terminal 15 provided as inner and outer electric connection parts, and mounting legs 25 of the container 12 are provided on the same side of a body of the container 12. In other words, the suction port 16, the discharge port 17, the terminal 15, and mounting legs 25 are concentrated on the same side of the body of the container 12 as shown in FIGS. 1 to 3 and FIG. 6. Because they are not axially protruded out of the end of the container 12, the size of the entire compressor in the axial direction is reduced till it becomes almost equal to the size of the container 12 in the axial direction. In addition, such a concentrated arrangement of structural components on the predetermined area of the container prevents them from taking up much space, so that it is more preferable than the arrangement of structural components dispersed around the container 12. In other words, as the suction port 16, the discharge port 17, the terminal 15, and the mounting legs 25 are arranged in a restricted area so as to be close to each other to share a part of or the whole of the wall of the container 12 in the thickness direction. Thus, the section of the container 12 on which each of them dominantly arranged is reduced. In addition, since the suction port 16 and the discharge port 17 are positioned on the body of the container 12, a margin S for connection of an external pipe 20 is obtained on the internal diameter side as shown in FIG. 1, by utilizing the fact that each of the outer and inner peripheries of the end of the container 12 tends to become a dead space 26. The wall of the container 12 in the thickness direction is shared much more, compared with the case of outwardly extending from the container 12, so that the reduction in size and weight of the container is achieved. The bulk of the container is further reduced as much as the extent of both the suction port 16 and the discharge port 17 which do not protrude out of the container 12.

Consequently, the compressor 11 with the built-in electric motor is made compact and light weight in addition to the reduction in cost. The compressor 11 is thus easily mounted on the mobile structure such as a vehicle 27 and contributes to energy saving.

Furthermore, each of the suction port 16, the discharge port 17, the terminal 15, and the mounting legs 25 are axially arranged on the container 12. Thus, the concentration of these structural components around the container 12 is increased, and it becomes more advantageous in the miniaturization and weight-saving.

Furthermore, one of the mounting legs 25 and the suction port 16 are paired, while another one of the mounting legs 25 and the discharge part 17 are paired. Then, these pairs are positioned on the opposite sides of the body of the container 12 in the longitudinal direction, respectively. In addition, the terminal 15 is located between these pairs. Thereby, the terminal 15 which tends to protrude outward is placed on an intermediate position between the above pairs, so that the terminal 15 is placed in a dead space 29 which exists in a wide variety of forms between the mounting portions 28 respectively including two mounting legs 25. Thus, the terminal 15 does not interfere with others even though it is arranged in the narrow cabinet of the vehicle 27, so that a wiring 31 to be connected from the outside and its wiring connection is protected from an undesired external force.

Furthermore, as shown in FIGS. 1 to 3 and FIG. 6, the suction port 16 and the discharge port 17 are located on the outermost portion of the container 12, i.e., the opposite ends of the container 12. With this constitution, the external pipes 20 for the refrigerating cycle are easily connected and disconnected outside the two mounting legs 25 on both sides of the connector 15 without being obstructed by the external wirings 31 to the terminal 15, and the two mount portions 28.

The container 12 is made of aluminum, so that it is advantageous to weight saving. In addition, such an aluminum container 12 can be easily molded into a desired shape, so that a cylindrically protruded connection opening 51 for mounting the terminal 15, the mounting legs 25, and so on are integrally molded on the container 12 as shown in FIGS. 1 to 6. Thus, it is advantageous to weight saving since there is no need to perform any additional work that takes a lot of trouble, such as post-mounting of each mounting leg and there is no factors that increase the weight of the resulting container, such as welding or bolt connection to be retrofitted. Furthermore, it is easy to work around a poor strength to be caused by retrofitting or the like even though the mounting legs 25 are provided for direct connection to the engine 2 of the vehicle 27 as in the present embodiment. The mounting legs 25 can be provided as specific mounting legs suitable for direct connection to the engine 2. As shown in the figures, the container 12 has a pair of the mounting legs 25 and another pair of mounting legs 32 which are positioned on opposite sides of the container 12 with respect to a diameter thereof.

Specifically, as the container 12 is made of aluminum, the container 12 can be integrally molded with the mounting legs 25, 32 with a simple structure without increasing its manufacturing cost, allowing an advantage of achieving a sufficient strength of the container 12 with a low cost. Thus, it is suitable for the usage such as direct connection to the engine 2 of the vehicle 27 in which the mounting strength is one of the important factors.

More specifically, the mounting legs 25, 32 are provided on the container 12 such that they are symmetrical with respect to a direction perpendicular to an axial line of the compressor 11. In addition, these legs 25, 32 are slightly projected from the periphery of the container 12 such that they are almost symmetrical with respect to the center of gravity (G) of the compressor 11. According to the present invention, however, the concrete configuration of these mounting legs 25, 32 is not limited to a specific one. The connection opening 51 is positioned to a coil end 13*a* of the electric motor 13 on the compression mechanism 10 side so as to make easy the connection between the terminal 15 and a connection terminal 13*b* of the coil end 13*a*. For providing the terminal 15 on the connection opening 51 formed in the body of the aluminum container 12, a sealing between the terminal 15 and the connection opening 51 is performed by means of conventional glass sealant. A connection plate 15*a* made of iron in the terminal 15 cannot be welded to the connection opening 51 made of aluminum, so that the connection plate 15*a* is used after being deformed into a flat shape. The terminal 15 is mounted on the connection opening 51 so as to satisfy the functions of pressure-proof and waterproof by placing the outer periphery of the iron connection plate 15*a* on a step portion 51*a* on the middle of the inner periphery of the connection opening 51 via a seal member 52 and by sandwiching the connection plate 15*a* between the step portion 51*a* and a ring nut 53 screwed from the opening end of the connection opening 51. The seal member 52 is attached in the inside of a groove of the step portion 51*a*. The terminal 15 has an inner connection terminal 15*b* in the inside of the connection plate 15*a* and an outer connection terminal 15*c* on the outside thereof. The number of terminals can be varied depending on the type of the electric motor 13 and the system of control. In the embodiment shown in the figures, the terminals include three power-supply terminals as the electric motor 13 is a three-phase motor and two signal terminals for a sensor of detecting the temperature of the electric motor 13.

In the compressor 11 with the built-in electric motor of the present example, as shown In FIG. 1, a sub-bearing part 42 that supports a sub-axial portion 14*a* of the driving shaft 14 by a sub-bearing 23 is formed on the end wall 41 integral with the body of the container 12. Also, the pump 19 is provided as a pump mechanism in a pump chamber 43 opened in the outer surface 41*a* of the end wall 42 and is then connected to the sub-axial portion 14*a* of the driving shaft 14, followed by closing the opening 43*a* of the pump chamber 43 by means of a closing member 44.

As shown in FIG. 1, the sub-bearing part 42 and the pump 19 are assembled and concentrated in the end wall 41 of the container 12. Here, the sub-bearing part 42 is on the side of the sub-axial portion 14*a* of the driving shaft 14 that actuates the pump 19, while the pump 19 includes the pump chamber 43. As a result, the bulk is prevented, compared with the bulk to be caused by distributing them around the container 12. In other words, they are arranged in a restricted area so as to be close to each other to share a part of or the whole of the wall of the container 12 in the thickness direction. In addition, they share a part of or the whole of a space in the container in the axial direction, so that the specific section and the specific space in the container are reduced, respectively. Thus, the size of the container 12 is reduced in the axial direction. Furthermore, the reduction in weight of the whole is achieved as much as reducing the specific section of the container 12 and the axial size of the container 12. Consequently, the compressor 11 with the built-in electric motor becomes compact in size and light weight, so that the decrease in cost is achieved. Furthermore, the compressor is easily mounted on the mobile structure such as a vehicle 27, contributing to the energy saving.

Furthermore, a positioning of the sub-bearing part 42 and sub-bearing 23 to the container 12 becomes unnecessary by integrating the sub-bearing part 42 of the driving-shaft 14 into the end wall 41 of the container 12. Thus, the positioning accuracy is increased while an assembling operation becomes ease, so that the cost is reduced accordingly.

The pump chamber 43 is opened to the external surface of the end wall 41 of the container 12. It is easy to post-fitting the pump 19 from the outside to connect to the sub-axial part 14*a* of the driving shaft 14 to be supported on the end wall 41 even though the pump chamber 43 is integrally formed in the end wall 41 of the container 12. In addition, after the connection, the opening may be closed by the closing member 44, so that the assembling operation is not complicated and does not take much time. Furthermore, as shown in FIGS. 1 to 3 and FIG. 6, the container 12 may be designed so as to be divided into a body part 12*a* and a lid portion 12*b* at a portion of the body. In this case, the divided portions are assembled together at a later time. Thus, the number of flanges 46 that are integrally molded for connection and the number of bolts 47 for joining the flanges 46 are reduced to further reduction in size and weight. In the embodiment shown in FIG. 5, there are four bolts 47 used. Each of a pair of the mounting legs 25 and a pair of the mounting legs 32, which are arranged in the axial direction of the container 12, does not stand on both sides of the boundary of the separated portions (i.e., the connected portion 45) of the container 12. These pairs are positioned on only one side of the boundary of the separated portions. In the figure, for example, they are arranged and concentrated on the container main body portion 12*a*. Thus, the load at the time of supporting the compressor 11 on the engine 2 or the like using the mounting legs 25 or 32 does not extend to the connection portion 45 between the body portion 12*a* and the lid portion 12*b* of the separated container 12. Accordingly, it is advantageous that there is no need to consider the load when the compressor 11 is fixed and supported on the container 12 by means of connection using bots 47 in the connection portion 45. The strength of connection between the container main body portion 12*a* and the lid portion 12*b* may only consider the pressure-proof to a refrigerant. A seal member 85 is provided on the connection portion 45 and is then attached in the groove of the side of the lid portion 12*b*.

Figure 4:
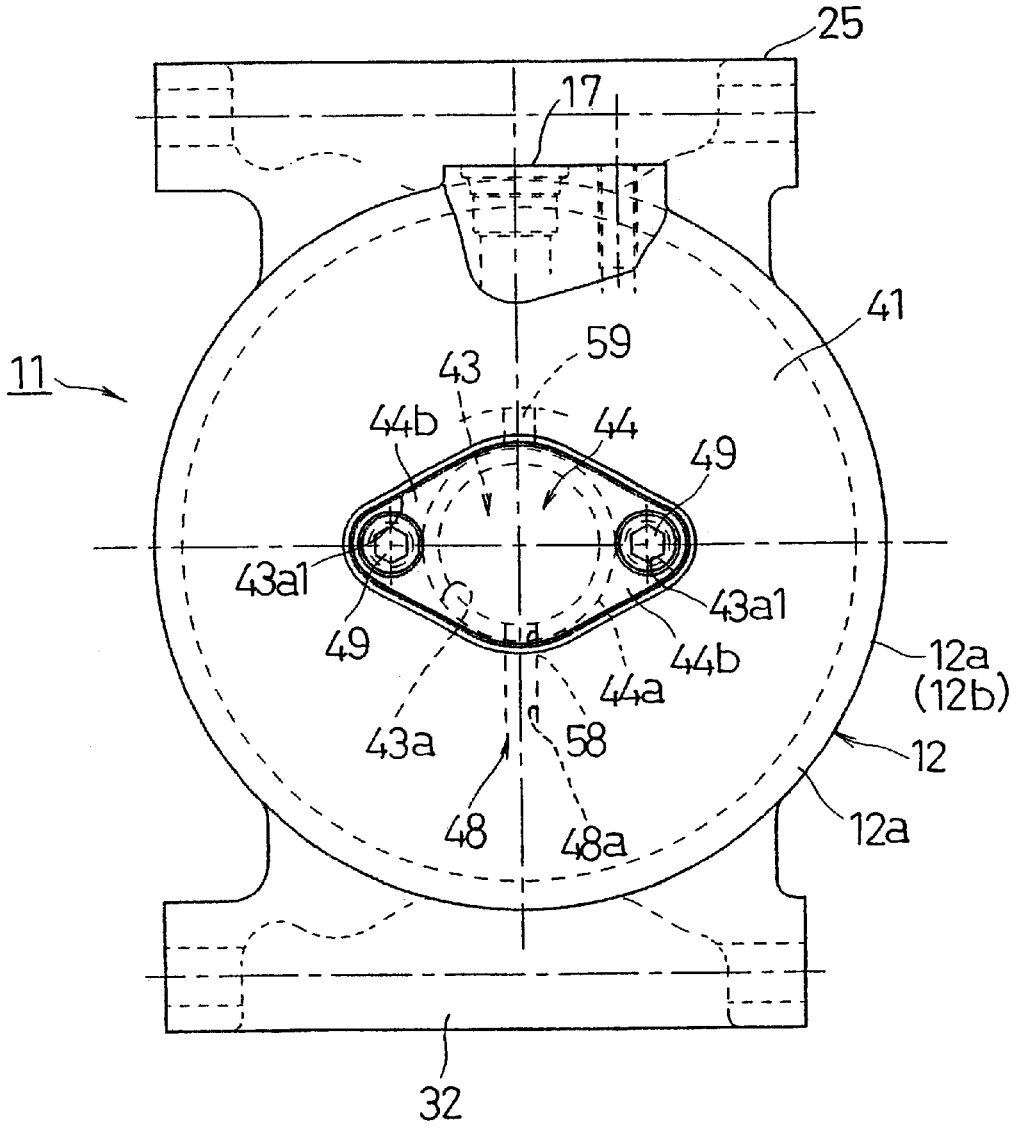
FIG. 4 is a side view from one end of the compressor shown in FIG. 1.
Figure 5:
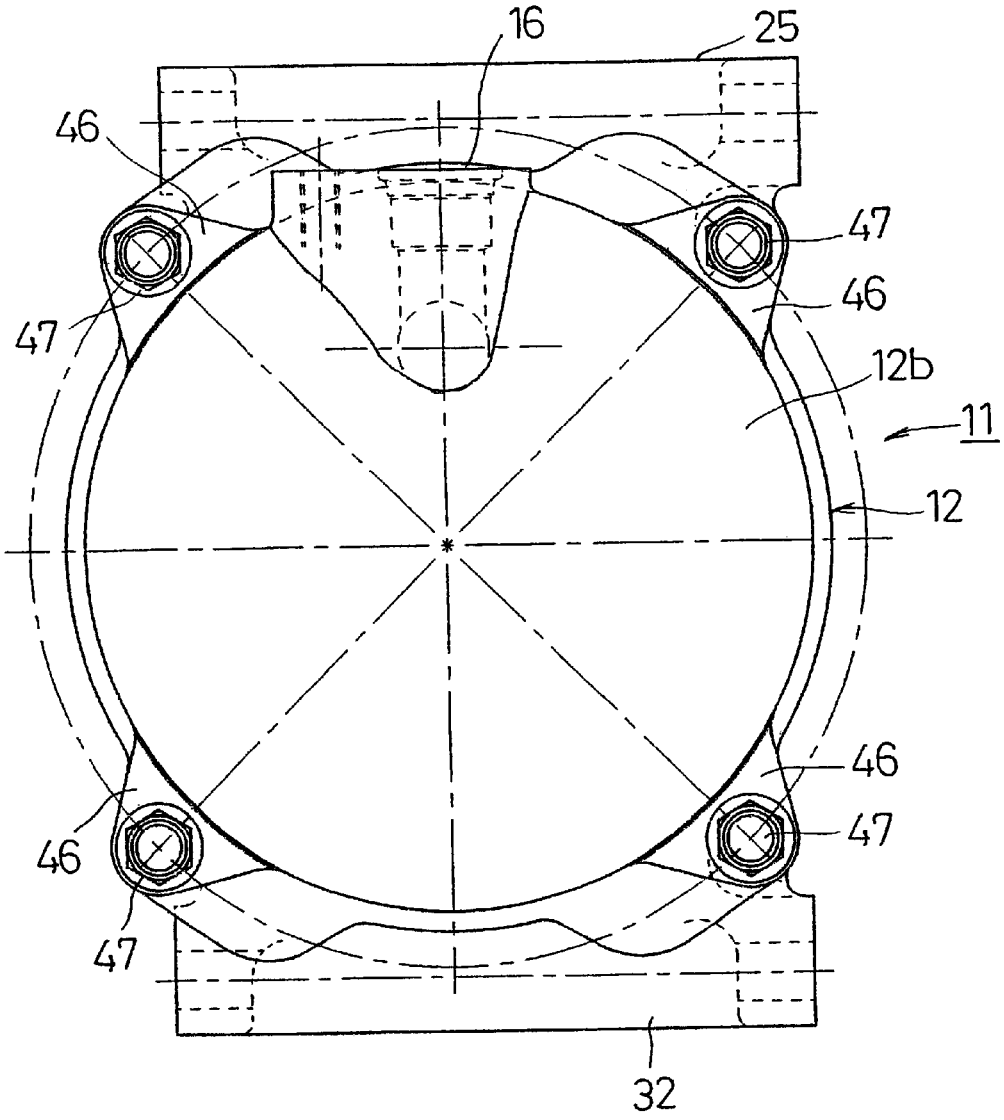
FIG. 5 is a side view from the other end of the compressor.
Figure 6:
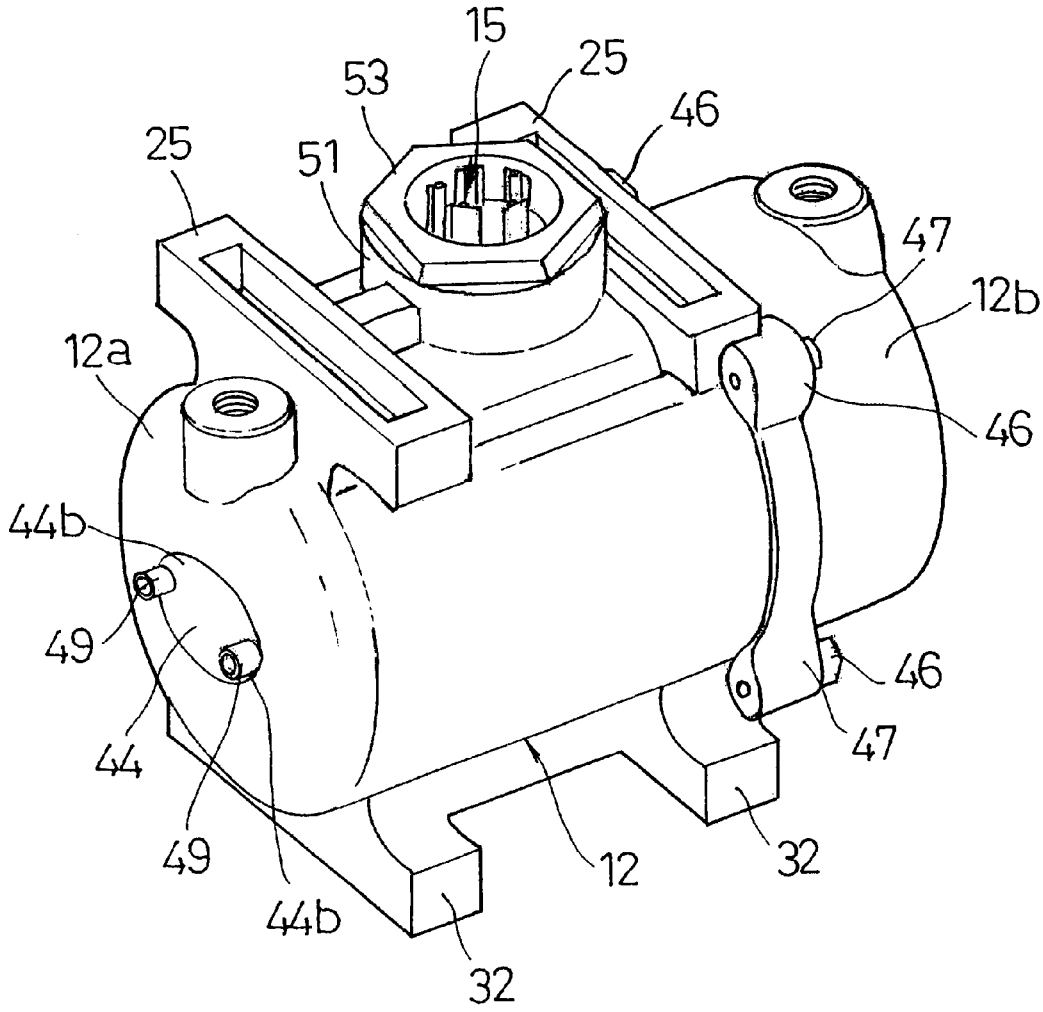
FIG. 6 is a perspective view of the compressor shown in FIG. 1.
Figure 7:
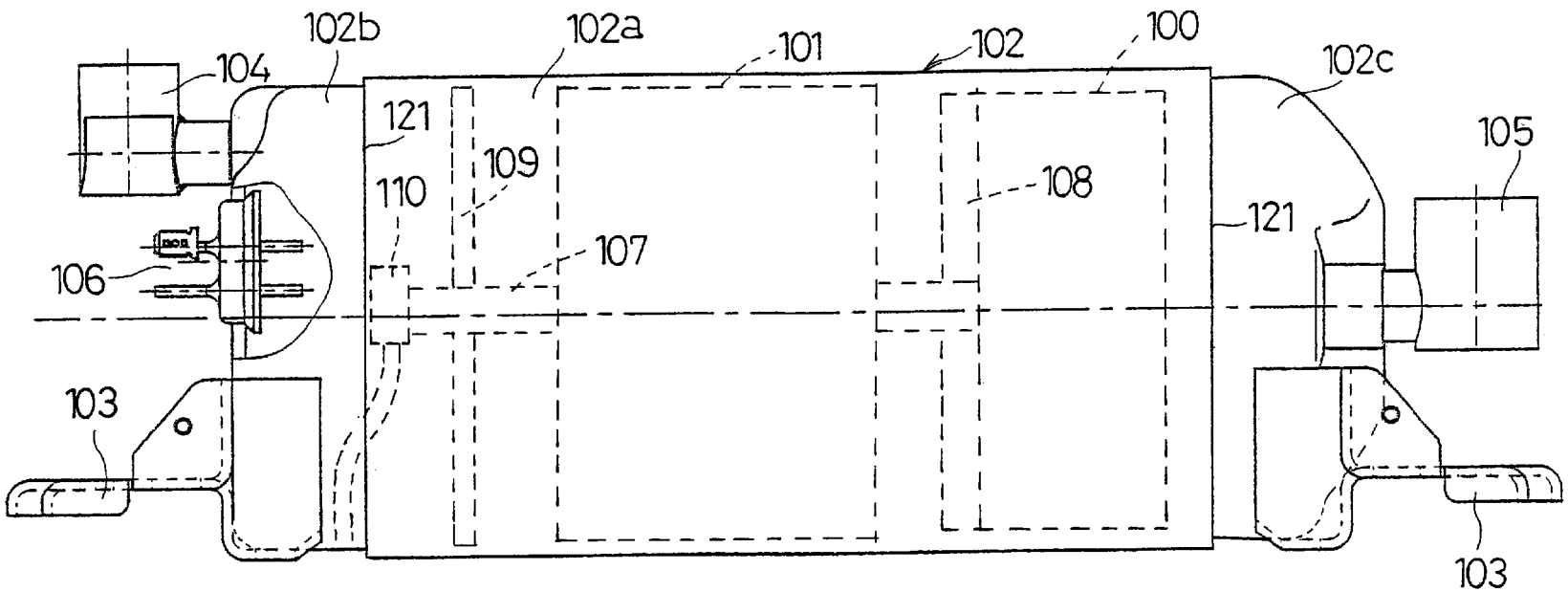
Fig. 7 Prior Art
FIG. 7 is a side view of a conventional compressor with a built-in electric motor housed in an iron container.
Figure 8:
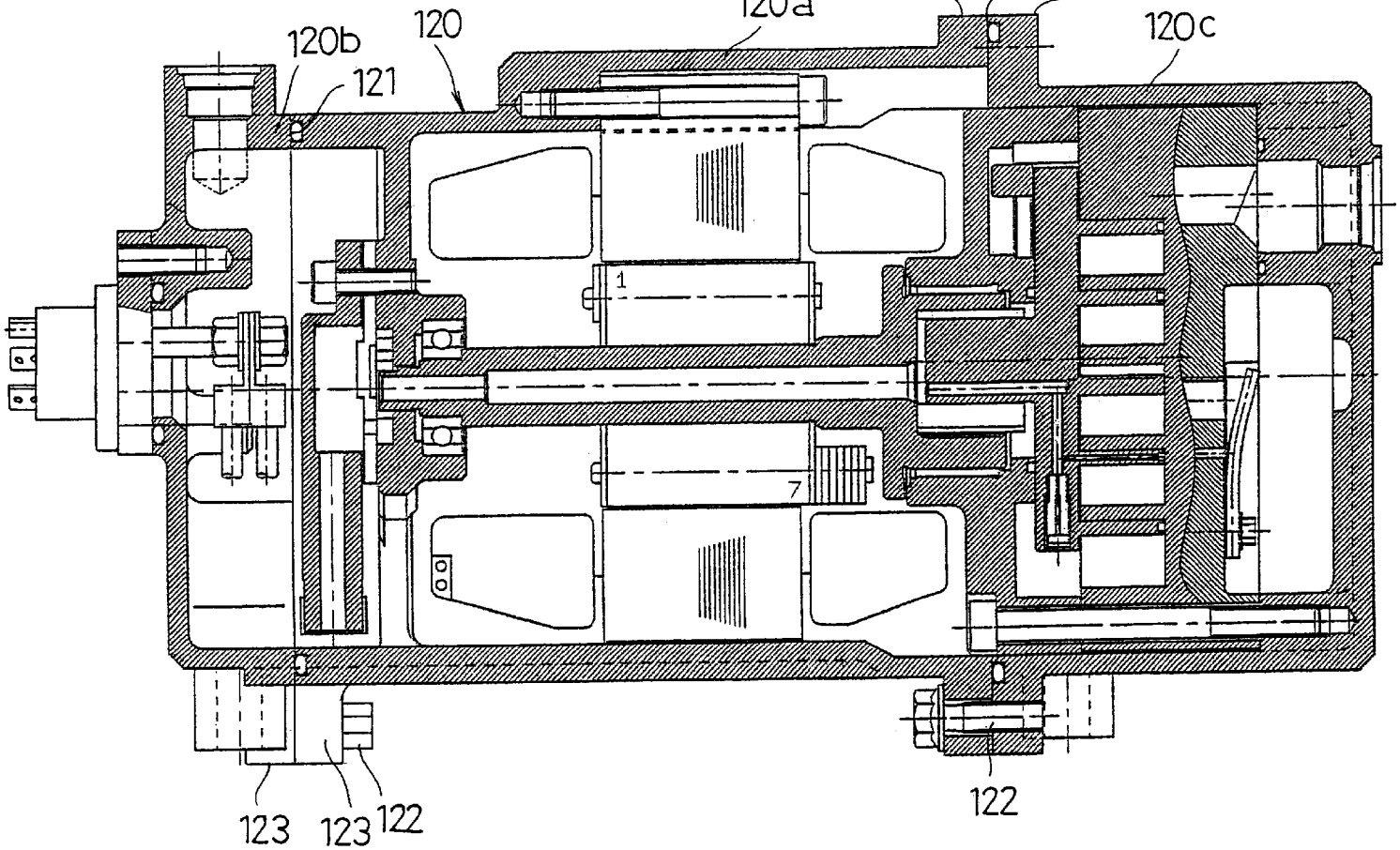
Fig. 8 Prior Art
FIG. 8 is a cross sectional view of a conventional compressor with a built-in electric motor housed in an aluminum container.
Figure 9:
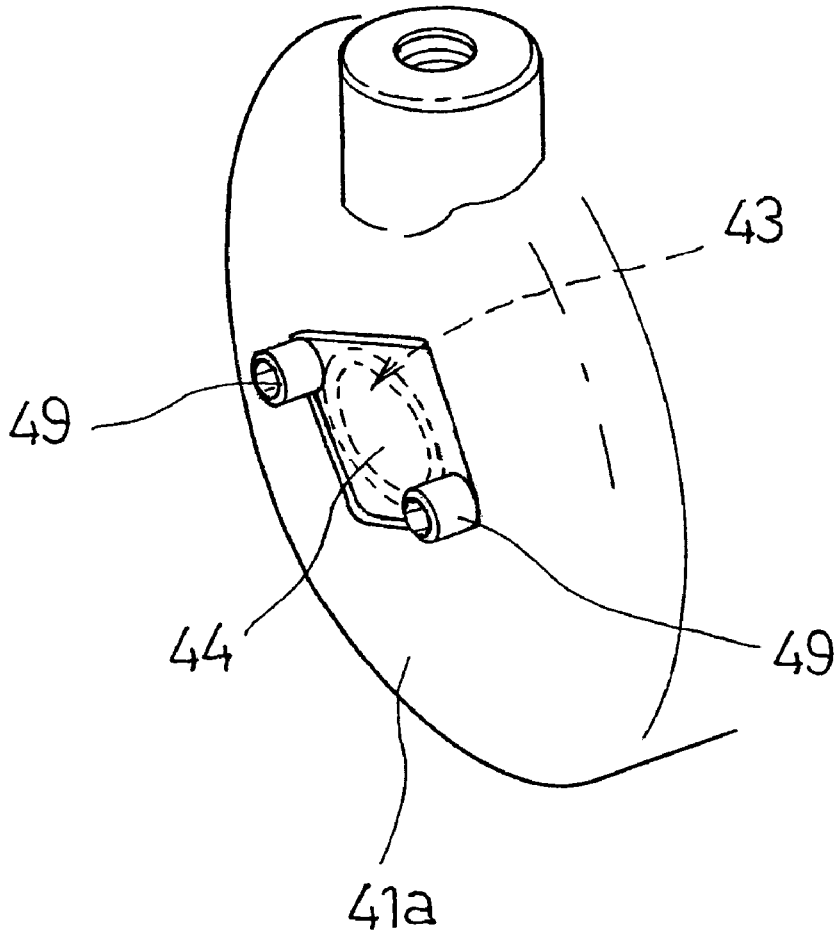
FIG. 9 is a perspective view showing an end of the compressor.

The pump chamber 43 is integrally formed as a circular recessed portion extending to the inside directly from the opening 43*a* of the external surface 41*a* of the end wall 41. The sub-axial part 14*a* of the driving shaft 14 of the back wall 41*b*, so that a pump 19 is constructed so as to be connected to the sub-axial part 14*a* at a position between the back wall 41*b* and a lid plate 54 placed on the back wall 41*b* from the outside. In addition, the suction port 19*a* is formed in the lid plate 54 and is opened to the pump chamber 43. The closing member 44 has a plug portion 44*a* to be fit into the pump chamber 43 from the opening 43*a* to a predetermined position, while a space between the outer periphery of the plug portion 44*a* and the inner periphery of the pump chamber 43 is sealed with a sealing member 55 to make the pump chamber 43 airtight. The sealing member 55 is attached in an outer peripheral groove of the plug portion 44*a*. The closing member 44 has a flange portion 44*b* integrally formed on an external end of the plug portion 44*a* as shown in FIGS. 1, 4, and 6. The flange portion 44*b* extends to the both sides in the radial direction and is fixed on the end wall 41 using the bolts 49 while it is fitted into a recessed portion 43*a*1 extending to the both sides from the opening 43*a*. Thus, the pump chamber 43 keeps its enclosed space with the closing member 44.

The closing member 44 may be smaller than the end wall 41 and may be located in the center of the end wall 41. The closing member 44 is fixed on the end wall 41 using two or a few bolts 49 or by being screwed into the opening 43*a*, so that it is allowed to make the pump chamber 43 close simply and easily. There is no need to provide any element which tends to cause the fabrication of the container 12 difficult or to cause the increase in weight and size of the container 12.

Furthermore, as shown in FIG. 1, there is an oil passage 48 formed in the end wall 41 of the container 12 such that the pump chamber 43 communicates to the oil storage portion 24 in the container 12. The oil passage 48 is formed such that it shares the wall of the container 12 in the thickness direction with other structural components. The oil passage 48 is thus formed to allow the tip 33 of the pump 19 to reach the bottom of the oil storage portion 24 to draw the oil 18 into the pump 19. Such a configuration of the oil passage 48 contributes to the reduction in size and weight of the container 12.

More specifically, the oil passage 48 is located around the pump chamber 43 formed in the end wall 41 of the container 12. The oil passage 48 has a passage portion 48*a* communicating through the pump chamber 43 on the axial line 56 shown in FIG. 1 which is located at the same position as that of the discharge port 17 opened to the outer periphery of the container 12 or at the position deviated from the discharge port 17. According to such a configuration of the oil passage 48, it is possible to make the passage portion 48*a* extending from the pump chamber 43 to the proximity of the bottom of the oil storage portion 24 by perforating from the outside through the discharge port 17. Thereby, the oil passage 48 that allows the communication between the pump chamber 43 and the oil storage portion 24 is formed without difficulty by perforating from the bottom of the oil storage portion 24 in the inside of the container 12 to the passage portion 48*b*.

Here, when the closing member 44 is located on a fixed position as shown in FIG. 1, the communication between the oil passage 48 and the discharge port 17 is blocked while allowing the communication between the oil passage 48 and the pump chamber 43. Concretely, as shown in FIGS. 1 and 4, the plug portion 44*a* of the closing member 44 is provided as a hollow portion, so that the wide space of the pump chamber 43 is obtained. Utilizing such a structural advantage, a communication pore 58 that communicates to the passage portion 48*a* of the oil passage 48 is formed only on a circumferential point on the peripheral wall of the plug portion 44*a* to allow the communication between the oil passage 48 and the pump chamber 43. On the other hand, as the passage portion 48*a* is perforated, an opening of an upper loophole 59 or the like formed in the pump chamber 43 is closed by fitting the peripheral wall of the plug portion 44*a* with the inner periphery of the pump chamber 43. A sealed portion by the sealing member 55 is located close to the external surface 41*a* of the end wall 41, compared with the positions of the communication pore 58 and loophole 59.

Thus, even though the loophole 59 communicating to the discharge port 17 and the inside of the container 12 are formed in the pump chamber 43 by means of the perforation through the discharge port 17, the closing member 44 is fixed on a predetermined position to close the loophole 59. Thereby, the pump chamber 43 is only communicated with the oil passage 48 without the addition of any particular structural component or any operation for closing the loophole 59.

As shown in FIG. 1, the pump chamber 43 has an oil filter 61. That is, the oil filter 61 is attached on the pump chamber 43 such that the outer periphery of the oil filter 61 is sandwiched between the plug portion 44*a* of the closing member 44 and the back wall 41*b* together with the lid plate 54 of the pump 19. The oil filter 61 is allowed to cover an extended area around the small suction port 19*a* of the pump 19 through the use of the space of the pump chamber 43. Compared with the configuration of the conventional compressor in which the oil filter is provided on the suction port of a narrow oil passage, the oil-passing area of the oil filter 61 is increased through the use of the pump chamber 43 having a wide space. In other words, the oil-passing resistance of the oil filter 61 is minimized. In addition, the life of such an oil filter 61 is prevented from being shortened, so that the oil 18 is stably supplied for a long time.

As shown in FIG. 1, there is an inner opening 17*a* of the discharge port 17 formed in the inner surface of the end wall 41 of the container 12. In addition, means for separating the oil 18 by blocking the inflow of a refrigerant, such as a plate-like oil separator 62, is provided in the inner opening 17*a* while leaving a gap 64 for introducing the refrigerant into the inside of the end wall 41. As shown in the figure, the oil separator 62 is fixed on a mounting surface 65 by means of a bolt 63. The mounting surface 65 is inwardly protruded from the inner opening 17*a* of the end wall 41 to some extent. The oil separator 62 is mounted without requiring an additional space such that it is placed on the position close to the inner opening 17*a* of the discharge port 17 formed by sharing the wall of the end wall 41 in the thickness direction. Accordingly, the oil separator 62 is capable of blocking the direct inflow of the refrigerant toward the discharge port 17 while allowing the separation of the oil components accompanied with the refrigerant.

As shown in FIG. 1, the above connection portion 45 of the container 12 is arranged on a position located between the built-in electric motor 13 and the compression mechanism 10 in the body of the container 12. Thus, if the container 12 is constructed of two body portions, a stator 13*c* of the electric motor 13 may be fixed on one of the container main body portions 12*a* by means of bolt connection, thermal insert, welding, or the like. In this case, there is no trouble in the work for assembling the rotor 13*e* of the electric motor 13 and the driving shaft 14. The fabrication of the container 12 is completed by connecting the compression mechanism 10 to the main axial part 14*b* of the driving shaft 14, followed by connecting to the remained lid portion 12*b*. As a whole, the compressor 11 is easily fabricated, compared with the conventional one.

In the other of the container main body portions 12*a*, more specifically, there is a housing space for fixing a main bearing member 71 for supporting the main bearing 21 on the compression mechanism 10 side of the driving shaft 14 by means of bolt connection, thermal insert, welding, or the like as shown in FIG. 1. Thus, the electric motor 13, the driving shaft 14, and the bearings on the opposite ends of the driving shaft 14 are easily and precisely aligned with reference to one of the container main body portions 12*a*. Subsequently, the compression mechanism 10 is connected to the main bearing member 71 in place on the driving side which has been previously positioned and fixed in place by means of bolts 72 or the like. Then, the remained lid portion 12*b* is connected to the container 12 using bolts 47. Consequently, the fabrication of the compressor is more facilitated.

The compression mechanism 10 shown in the figures is a scroll type one and is constructed of a fixed scroll 73 secured on the main bearing member 71 by means of bolt connection and a swing scroll 74 having spiral wings being interlocked with each other, where the swing scroll 74 is sandwiched between the main bearing member 71 and the fixed scroll 73. The compression mechanism 10 is assembled before assembling the main bearing member 71 into the container main portion 12*a*. Furthermore, the compression mechanism 10 is mounted on the lid portion 12*b* together with the main bearing member 71 by means of bolt connection or the like. Subsequently, the resulting integrated components are installed in the container main body portion 12*a*. The main axial part 14*b* has an eccentric shaft 14*c* for driving the scroll-type compression mechanism 10. The eccentric shaft 14*c* is designed to fit to the swing scroll 74 through the bearing 22. Thus, the eccentric shaft 14*c* imparts a swing motion to the swing scroll 74 along a predetermined circular orbit by the rotation of the driving shaft 14. For preventing an undesired rotation of itself at the time of swing motion, a rotation-preventing mechanism 75 is provided between the main bearing member 71 and the swing scroll 74.

When the swing scroll 74 starts its swing motion, a compression chamber 76 between the fixed scroll 73 and the swing scroll 74 moves from the outer peripheral portion to the center portion while reducing its volume to compress the refrigerant being introduced from the suction port 77 in the outer peripheral portion. As the refrigerant being compressed reaches to a predetermined pressure, the compressed refrigerant is discharged in the container 12 from the discharge port 78 in the center portion through a lead valve 79.

The suction port 16 of the container 12 is formed such that it shares the wall of another end wall 81 in the thickness direction formed by the lid portion 12*b*. In other words, the suction port 16 is formed so as to extend through the inner dead space 26 of the outer peripheral portion of the container 12. In this case, the opening 16*a* of the suction port 16 to the inside of the end wall 81 is positioned such that it is directly communicated with the suction port 77 of the compression mechanism 10. Thus, the suction passage 82 of the refrigerant and the discharge chamber 83 are coexisted without requiring a specific structural component in an area between the compression mechanism 10 and the lid portion 12*b*. The refrigerant is discharged into the discharge chamber 83. Then, the refrigerant reaches to the side of the electric motor 13 through a passage 84 formed between the compression mechanism 10 and the main axial member 71 or between the container 12 and each of them. Then, the electric motor 13 is cooled by the refrigerator. After the cooling, the refrigerator reaches to the discharge port 17.

From the above description, the compressor 11 having the built-in electric motor 13 in each of the cases described above is appropriately applied for a mobile structure to be used together with the battery. In addition, it is also appropriately applied for constructing a mobile structure such as a vehicle 27 on which the compressor 11 having the built-in electric motor 13 is mounted together with the battery 1.

The vehicle 27 may not be limited to a specific one such as a gasoline-powered vehicle, a hybrid vehicle, or an electric-powered vehicle. The present invention can be applied on various kinds of the mobile structures including special-purpose vehicles and working-purpose vehicles.

According to the first aspect of the invention, the size of the whole compressor in the axial direction is reduced till it becomes almost equal to the size of the container in the axial direction. In addition, such a concentrated arrangement of structural components on the predetermined area of the container prevents them from taking up much space, compared with the arrangement of structural components dispersed around the container. As a whole, the compressor is made compact and lightweight.

According to the second aspect of the invention, the bearing portion on the driving side of the pump mechanism by the driving shaft of the compressor and the pump mechanism portion are assembled and concentrated in the end wall of the container. Such a concentrated arrangement prevents them from taking up much space, compared with the arrangement of structural components dispersed around the container. In other words, they are arranged in a restricted area so as to be close to each other to share a part of or the whole of the wall of the container in the thickness direction. In addition, they share a part of or the whole of a space in the container in the axial direction, so that the specific section and the specific space in the container are reduced, respectively. Thus, the size of the container is reduced in the axial direction. Furthermore, the reduction in weight of the whole is achieved in the axial direction as much as reducing the specific section of the container.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A compressor with a built-in electric motor, comprising:

a compression mechanism;

a built-in electric motor for driving the compression mechanism; and a container for housing the compression mechanism and the built-in electric motor, the container comprising a suction port, a discharge port, inner and outer electric connection parts, and mounting legs, which are provided on a same side of the container;

wherein said suction port extends from a side of said container at a first end thereof adjacent to a first mounting leg and said discharge port extends from said side of said container at a second end thereof adjacent to a second mounting leg, and said suction port and said discharge port do not protrude axially from said container such that an axial length of said compressor is substantially the same as an axial length of said container.

2. The compressor with a built-in electric motor according to claim 1, wherein the suction port, the discharge port, the inner and outer electric connection parts, and the mounting legs of the container are aligned in an axial direction of the container.

3. The compressor with a built-in electric motor according to claim 2, wherein one of the mounting legs and the suction port are paired, while another one of the mounting legs and the discharge port are paired, the pairs are positioned on opposite sides of the container in a longitudinal direction of the body, and the inner and outer electric connection parts are provided between the pairs.

4. The compressor with a built-in electric motor according to claim 3, wherein the suction port and the discharge port are located at an outermost portion of the container.

5. The compressor with a built-in electric motor according to claim 1, wherein the container is made of aluminum.

6. The compressor with a built-in electric motor according to claim 1, wherein the mounting legs are integrally molded with the container and are designed for direct connection to a vehicle engine.

7. The compressor with a built-in electric motor according to claim 1, wherein the compressor is used together with a battery.

8. A mobile structure mounted with the compressor with a built-in electric motor according to claim 1; and a battery.

9. A compressor with a built-in electric motor, comprising:

a scroll type compression mechanism;

a built-in electric motor for driving the scroll type compression mechanism;

a container for housing the scroll type compression mechanism and the built-in electric motor;

a bearing part for supporting an end of a driving shaft for driving the scroll type compression mechanism, which is formed on an end wall integral to a body of the container, the end of the driving shaft to be supported by the bearing part being located in a direction opposite to the scroll type compression mechanism, the driving shaft being connected to the built-in electric motor, and the scroll type compression mechanism positioned at a closed end of the container;

a pumping mechanism provided in a pumping chamber opened to an external surface of the end wall, the pumping mechanism being connected to the end of the driving shaft in a direction opposite to the scroll type compression mechanism; and a closing member for closing the opening of the pumping chamber.

10. The compressor with a built-in electric motor according to claim 9, wherein the closing member is fixed on the end wall by means of bolt connection or is fixed on the pumping chamber by means of screwing the closing member into the pumping chamber.

11. The compressor with a built-in electric motor according to claim 9, wherein an oil passage is formed in the end wall of the container, for making communications between the pumping chamber and an oil storage portion in the container.

12. The compressor with a built-in electric motor according to claim 9, wherein a discharge port of the container is formed around the pumping chamber such that the discharge port is opened to an outer periphery of the container, and the discharge port has a portion formed on a same axial line to be communicated with the oil passage through the pumping chamber.

13. The compressor with a built-in electric motor according to claim 12, wherein the closing member blocks the communication between the oil passage and the discharge port while allowing the communication between the oil passage and the pumping chamber when the closing member is located on a predetermined fixed position.

14. The compressor with a built-in electric motor according to claim 9, wherein an oil filter is arranged in the pumping chamber.

15. The compressor with a built-in electric motor according to claim 9, wherein an inner opening of the discharge port is formed in a inner surface of the end wall of the container, and an oil separator for separating oil by interrupting an inflow of refrigerant into the inner opening is formed in the inside of the end wall.

16. The compressor with a built-in electric motor according to claim 9, wherein a single connection portion is formed on a predetermined area of the body of the container, which corresponds to an area between the electric motor and the compression mechanism.

17. The compressor with a built-in electric motor according to claim 9, wherein the container is made of aluminum, on which mounting legs are integrally formed.

18. The compressor with a built-in electric motor according to claim 17, wherein the mounting legs are directly connected to a vehicle engine.

19. The compressor with a built-in electric motor according to claim 9, wherein the compressor is used together with a mobile battery.

20. A mobile structure mounted with the compressor with a built-in electric motor according to claim 9, along with a battery.

21. A compressor with a built-in electric motor, comprising:

a compression mechanism;

a built-in electric motor for driving the compression mechanism;

a container for housing the compression mechanism and the built-in electric motor;

a bearing part for supporting an end of a driving shaft for driving the compression mechanism, which is formed on an end wall integral to a body of the container, the end of the driving shaft to be supported by the bearing part being located in a direction opposite to the compression mechanism, the driving shaft being connected to the built-in electric motor;

a pumping mechanism provided in a pumping chamber opened to an external surface of the end wall, the pumping mechanism being connected to the end of the driving shaft in a direction opposite to the compression mechanism; and a closing member for closing the opening of the pumping chamber;

wherein a discharge port of the container is formed around the pumping chamber such that the discharge port is opened to an outer periphery of the container, and the discharge port has a portion formed on a same axial line to be communicated with the oil passage through the pumping chamber.

22. A compressor with a built-in electric motor, comprising:

a compression mechanism;

a built-in electric motor for driving the compression mechanism;

a container for housing the compression mechanism and the built-in electric motor;

a bearing part for supporting an end of a driving shaft for driving the compression mechanism, which is formed on an end wall integral to a body of the container, the end of the driving shaft to be supported by the bearing part being located in a direction opposite to the compression mechanism, the driving shaft being connected to the built-in electric motor;

a pumping mechanism provided in a pumping chamber opened to an external surface of the end wall, the pumping mechanism being connected to the end of the driving shaft in a direction opposite to the compression mechanism; and a closing member for closing the opening of the pumping chamber;

wherein an inner opening of the discharge port is formed in a inner surface of the end wall of the container, and an oil separator for separating oil by interrupting an inflow of refrigerant into the inner opening is formed in the inside of the end wall.

* * * * *